United States Patent [19]

Piatt et al.

[11] Patent Number: 4,709,248

[45] Date of Patent: Nov. 24, 1987

[54] TRANSVERSE PRINTING CONTROL SYSTEM FOR MULTIPLE PRINT/CARTRIDGE PRINTER

[75] Inventors: Michael J. Piatt, Enon; Randy Ray, Miamisburg, both of Ohio

[73] Assignee: Eastman Kodak Company, Rochester, N.Y.

[21] Appl. No.: 945,138

[22] Filed: Dec. 22, 1986

[51] Int. Cl.[4] ..... G01D 15/16

[52] U.S. Cl. ..... 346/140 R; 400/126; 400/175

[58] Field of Search ..... 346/140; 400/126, 175

[56] References Cited

U.S. PATENT DOCUMENTS

| | | | |
|---|---|---|---|
| 4,364,067 | 12/1982 | Koto | 346/140 |
| 4,500,895 | 2/1985 | Buck | 346/140 |
| 4,544,931 | 10/1985 | Watanabe et al. | 346/140 R |
| 4,571,599 | 2/1986 | Rezanka | 346/140 R |
| 4,628,334 | 12/1986 | Dagna | 346/140 |

*Primary Examiner*—Joseph W. Hartary
*Attorney, Agent, or Firm*—John D. Husser

[57] ABSTRACT

Ink jet printer for printing along a linear print zone with a plurality of insertable print/cartridges employs a carriage for traversing the print zone and supporting the print/cartridges with their orifice arrays mutually indexed to a carriage reference that is parallel to the direction of carriage traverse; detecting and storing the relative transverse locations of the indexed orifice arrays; and controlling the actuations of the supported print/cartridges in accordance with their detected transverse locations. A detecting and storing sub-system detects and stores inter-array spacings in the form of encoder mark-count plus intra-mark phase information. A control sub-system: (1) outputs printing information signals for the print/cartridges on the basis of the stored mark-count information; and (2) enables print/cartridge actuations in sequential orders based on the stored intra-mark phase information. These orders differ in forward and retrace printing.

8 Claims, 21 Drawing Figures

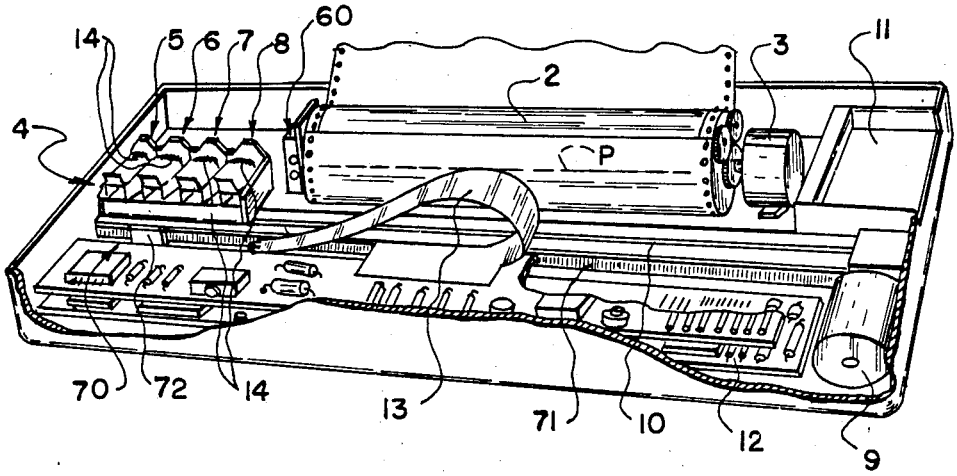
FIG. 1
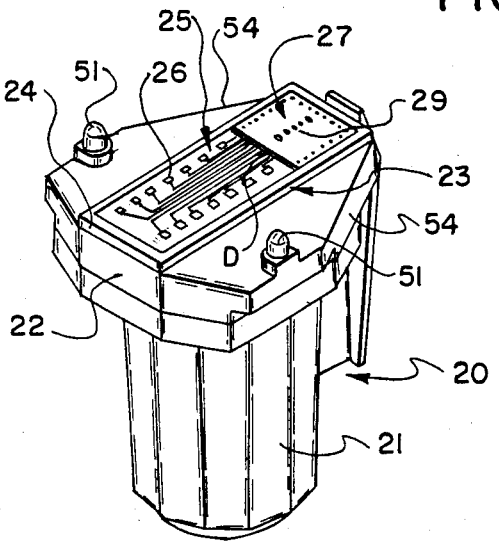
FIG. 2
FIG. 3
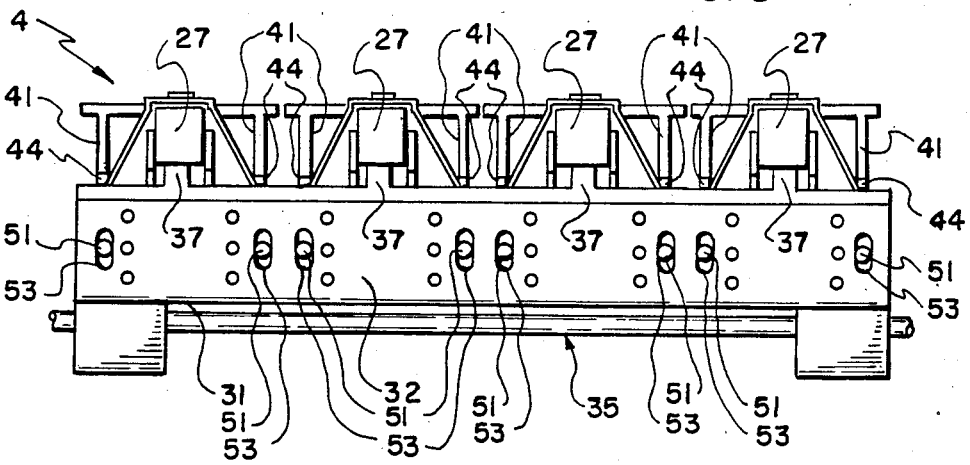

TRANSVERSE PRINTING CONTROL SYSTEM FOR MULTIPLE PRINT/CARTRIDGE PRINTER

BACKGROUND OF THE INVENTION

1. Field of the Invention

The present invention relates to ink jet printing apparatus employing a plurality of cooperative print/cartridges and more particularly to control systems for coordinating the printing of such print/cartridges during transversing passes across a print medium 2. Background Art Commonly assigned and concurrently filed U.S. patent application Ser. No. 945,136, entitled "Ink Jet Printer for Cooperatively Printing with a Plurality of Insertable Print/Cartridges", by M. Piatt describes a highly useful approach for ink jet printing with a plurality of insertable print/cartridges. In general, that approach employs the physical positioning of each inserted print/cartridge so that its linear orifice array each is aligned: (i) precisely perpendicular to the direction of line traverse, (ii) at a precise predetermined distance from a reference surface parallel to the direction of line traverse and (iii) at a generally predetermined spacing from the printing zone. This aspect of the Piatt approach prevents printing artifacts caused by misalignments of the cooperative print/cartridges in the vertical page direction. To prevent artifacts due to misalignments along the horizontal page direction, the Piatt approach utilizes detections of the relative transverse locations of the linear orifice arrays of inserted print/cartridges and coordination of the print/cartridges printing actuations based on such detections. Commonly assigned U.S. patent application Ser. No. 945,134, entitled "Multiple Print/Cartridge Ink Jet Printer Having Accurate Vertical Interpositioning", and concurrently filed in the names of Piatt, Houser and McWilliams, describes particularly preferred systems for attaining the above-described physical positioning of insertable print/cartridges. Commonly assigned U.S. patent application Ser. No. 945,137, entitled "System for Determining Orifice Interspacings of Cooperative Ink Jet Print/Cartridges", and concurrently filed in the names of Piatt, Theodoras and Ray, describes highly useful systems for scanning inserted print/cartridges and computing and storing the relative transverse locations of the orifice arrays thereof to enable coordination of the drop placements during line printing traverses.

SUMMARY OF THE INVENTION

One significant object of the present invention is to provide systems for coordinating such inserted print/cartridges in a manner achieving high resolution drop placement control.

A related object of the present invention is to provide highly useful improvements for high resolution detection of print/cartridge orifice arrays.

Another object of the present invention is to provide multiplexing systems which advantageously cooperate with such high resolution print control systems in a manner which reduces component and power requirements for the printer apparatus.

Another important object of the present invention is to provide systems for selectively varying the coordination of a plurality of such inserted print/cartridges, in forward and retrace printing sequences, to provide enhanced drop placement control.

Thus, the present invention provides improvements in ink jet printing apparatus which cooperatively prints successive pixels along a linear print zone with a plurality of insertable print/cartridges, having orifice arrays. Such printing apparatus includes: (a) carriage means for traversing the print zone and supporting the print/cartridges with their orifice arrays mutually indexed to carriage referencing means that is precisely parallel to the direction of carriage traverse; (b) means for detecting and storing the relative transverse locations of the orifice arrays; and (c) means for controlling the actuations of the print/cartridges in accordance with their detected transverse locations. In accord with one aspect of the present invention, the detecting and storing means detects and stores inter-array spacings in the form of encoder mark-count plus intra-mark phase information. In a related aspect the controlling means is constructed to: (1) output printing information signals for the print/cartridges on the basis of the stored mark-count information; and (2) enable print/cartridge actuations in a sequential order based on the stored intra-mark phase information.

BRIEF DESCRIPTION OF DRAWINGS

The subsequent description of preferred embodiments refer to the attached drawings wherein:

FIG. 1 is a prespective view, with cover portions removed, of one preferred printer embodiment in accord with the present invention;

FIG. 2 is a perspective view of one embodiment of disposable print/cartridge which is useful in accord with the present invention;

FIG. 3 is a view of the print/cartridge carriage of the FIG. 1 printer embodiment, as viewed from the print zone side of the apparatus;

DETAILED DESCRIPTION OF PREFERRED EMBODIMENTS

Figure 4A:
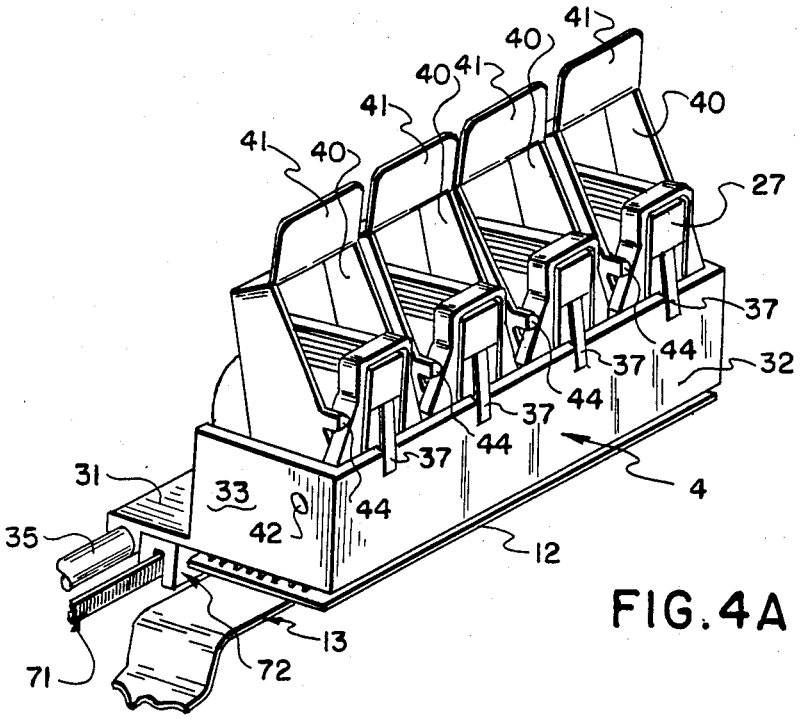
FIGS. 4A and 4B are respectively a perspective and a side view, partially in cross section, of the print/cartridge carriage shown in FIGS. 1 and 3.

The ink jet printing apparatus shown in FIG. 1 in general comprises a print medium advancing platen 2 which is adapted to receive sheet or continuous print material, e.g. paper, from an ingress at the lower rear, and under the drive from motor 3, advance successive line portions of the medium past a print zone P, and out of the printer through a printer egress in the top of the printer. During the passage of successive line portions through the print zone, multi print/cartridge carriage 4 is traversed across the print zone so that print/cartridges placed in the four individual carriage nests 5, 6, 7 and 8 can effect printing operations, as subsequently described. The carriage 4 is slidingly mounted on a guide rail means 35 (see FIGS. 3, 4A and 4B) located beneath the print/cartridge support nests 5–8 and a carriage drive motor 9 effects traversing movement of the carriage 4, past the platen face, via an endless cable 10 attached to carriage 4. The printer is electrically energized, e.g. from a battery or transformer located at 11, via a control circuit means 12. Electrical energy is supplied to individual print/cartridges by means of ribbon cables 13 which have terminals 14 in the lower portion of each of support nests 5–8.

Referring now to FIG. 2, there is shown one useful print/cartridge embodiment 20, which is adapted to be removably inserted into an operative relation with the printer via carriage 4. The print/cartridge 20 is adapted to be disposable when empty of ink and in general comprises an ink supply reservoir 21 and cover member 22, which covers the ink reservoir and, together with position lugs 51, coarsely positions the print head assembly 23 in nests 5–8. The print head assembly 23 is mounted on the cover member and comprises a driver plate 24 having a plural of electrical leads 25 formed thereon. The leads 25 extend from connector pads 26 to resistive heater elements (not shown) located beneath each orifice 29 of a linear orifice array formed in orifice plate 27. Ink from reservoir 21 is supplied through cover member 22 to a location beneath each orifice 29 of plate 27 (and above the heater element for that orifice). Upon application of an electrical print pulse to a terminal pad by the printer control, the corresponding resistive heater element causes an ink vaporization condition which ejects a printing ink droplet from its coresponding orifice 29. The orifice plate 27 can be electroformed using photofabrication techniques to provide precisely located orifices and is attached to driver plate 23, which is in turn affixed to the cover member 22. Thus it will be appreciated that even through the linear array of orifices 29 is precisely located within the orifice plate 27, its position vis-a-vis the locating portions of cover member 22 and positioning lugs 51 is not precisely consistent, e.g. in the vertical or horizontal directions, for different disposable print/cartridges. Print/cartridges of the type just described are known in the art for use in single print/cartridge printers, and, as has been noted, the coarse locating structures are adequate for those applications.

Figure 4B:
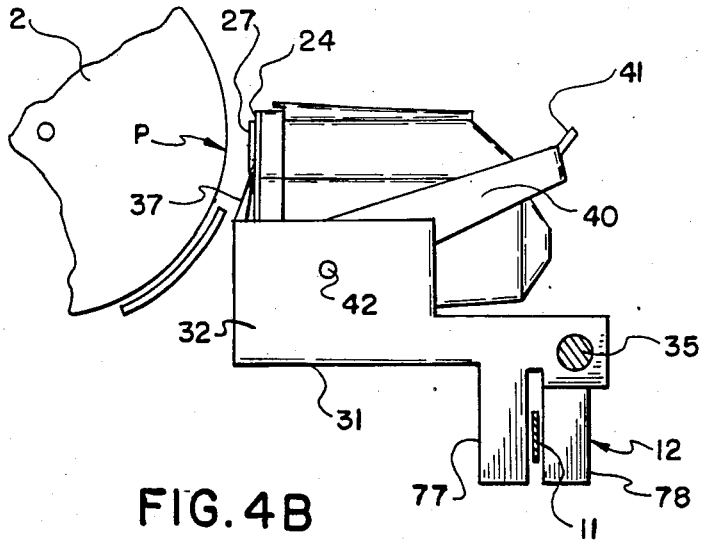

Referring now to FIGS. 3, 4A and 4B, the print/cartridge carriage 4 comprises a bottom wall portion 31, a front wall portion 32 and side wall portions 33 which together form the plurality of print/cartridge nests 5–8 that are adapted to receive and coarsely position print-/cartridges with respect to the printing zone P of the printer. The bottom of wall portion 31 is mounted on guide rail means 35 for traversing the carriage across the print zone P in a precisely uniform spacial relation to the platen 2 and in a direction substantially parallel to the axis of that platen's axis of rotation. Thus, the direction of the carriage traverse is substantially orthogonal to the direction of print medium advance.

Figure 5:
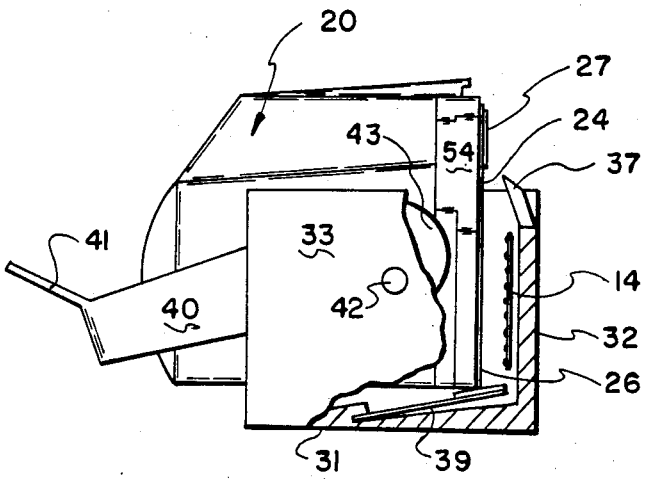
FIGS. 5–8 are views showing various stages of the print/cartridge positioning sequence.
Figure 6:
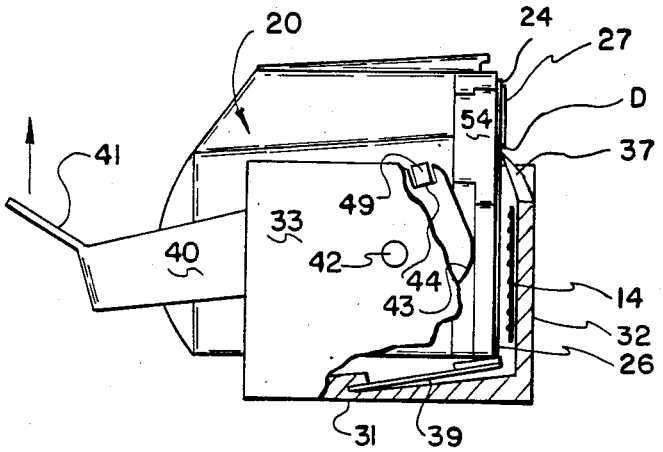
Figure 7A:
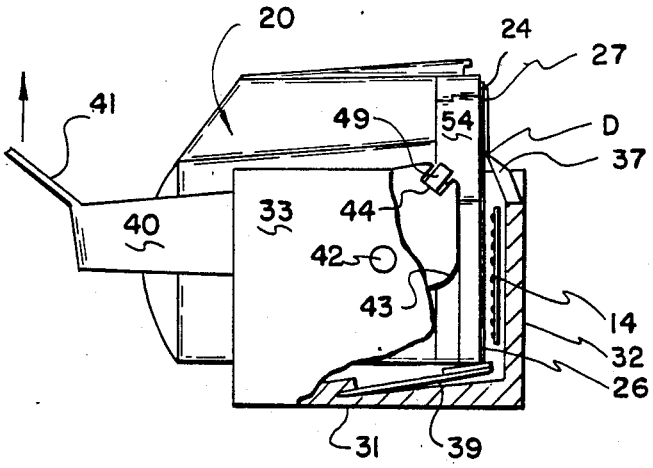
Figure 7B:
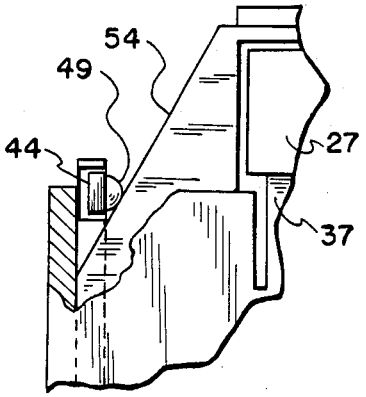

The top of the front wall 32 of each print/cartridge nest 5–8, has, as an upper extension, knife portions 37, which form reference edges that are precisely colinear, parallel to the direction of carriage translation and equidistantly spaced from the linear print zone P. Mounted on the outer side walls of the carriage 4 is fastening means 40 for contacting print/cartridges, which have been inserted into nests 5–8, and moving such print/cartridges into precise operating position in the printer apparatus. Referring to FIG. 5, it can be seen that the fastening means 40 comprises lever arm portions 41, hinge portions 42, camming portions 43 and seating arm portions 44. The bottom wall 31 of each nest 5–8 also comprises a resilient portion 39 and the fastening means is adapted to move the bottom of an inserted print/cartridge into a force engagement that downwardly compresses resilient portion 39, when the lever arm portion 41 is moved upwardly to the position shown in FIGS. 3, 4A and 4B. When lever arm portion 41 is moved downward, the fastening means 40 is disengaged and the print/cartridge 20 can be hand-lifted from its nest in the carriage 4.

Referring now to FIG. 2, as well as FIGS. 3–8, the orifice plate vertical positioning system is designed to provide a predetermined sequence of engagements between the print/cartridge 20 and the carriage 4. First, the print/cartridge is hand-inserted into a coarsely positioned alignment resting loosely in a nest on top of cantilever spring 39 (see FIG. 5). As shown in FIG. 3, positioning lugs 51 of the print/cartridge are located in vertical slots 53. As the fastening means 40 is rotated clockwise (as viewed in FIGS. 5, 6, 7A and 8), the cam portion 43 first urges the smooth top surface of the driver plate 24 into forced contact with knife edge 37 (see FIG. 6). At this stage the cam dimples 49 on seating arm portions 44 have not yet contacted the print/cartridge sidewalls. During continued rotation the cam dimples 49 contact shoulder portions 54 of an inserted print/cartridge 20 and move the print/cartridge downwardly against the bias of resilient means 39, while cam portion 43 maintains the forward force urging the drive plate 24 into contact with knife edge 37. During this downward movement, knife edge 37 will slide along the face of the driver plate 24 until a detent surface D of the print/cartridge engages the knife edge (see FIG. 7A). In the embodiment shown in FIGS. 2–8, the detent D comprises a lower edge portion of the orifice plate 27. As the engagement between the knife edge 37 and the detent edge D evolves, the print/cartridge is oriented within the nest so that the detent edge D is precisely parallel to the knife edge. Because the orifice array 29 and the detent edge D of the orifice plate 27 are photofabricated, they can be precisely located relative to one another in an economical fashion. Thus precise positioning of the orifce plate's detent edge D relative to the knife edge 37 of a carriage nest precisely locates the printing orifices (rotationally and vertically) relative to the the traversing path of the printer carriage 4, as well as in a predetermined spacial relation vis-a-vis the print zone P.

Figure 8:
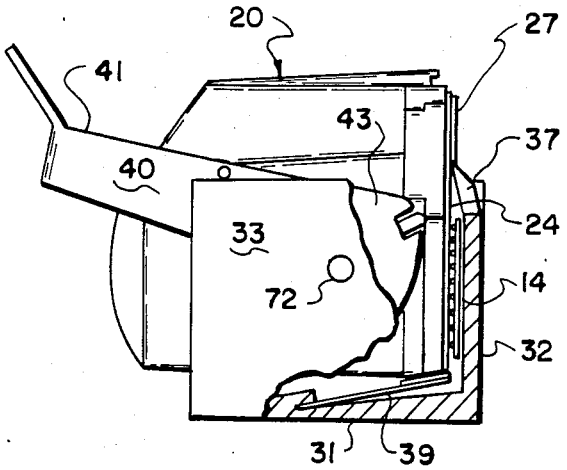

Continued movement of the lever arm 41 causes cam surface 43 to move connector pads 26 of the print/cartridge into contact with the terminals 14 in the nest bottom (see FIG. 8). To allow continued movement of the fasten means 40, after full detenting of the orifice plate, the seating arms 44 are slightly flexible in an outward direction (see FIG. 7B) to allow dimples 49 to slip down the sides of shoulder 54. As shown best in FIG. 7B, the thickness of cantilever seating arm 44 behind dimple 49 is less than the other portions of the Fastening means 40 to allow this outward movement. The knife edge 37 can yield slightly to the right (as viewed in FIG. 8) to allow firm contact between the cartridge pads 26 and the nest terminals 14.

The print/cartridge positioning structure just described is the subject of the previously mentioned Piatt, Houser and McWilliams application. It will be understood that this structure precisely positions the orifice plate 27 and thus the linear orifice array 29 of an inserted print/cartridge relative to the knife edge 37 of its nest. The knife edges 37 of the print/cartridge nests 5–8 are carefully aligned to be mutually colinear with a uniform spacing from the print zone P. The line defined by the referencing surfaces of knife edges 37 is precisely parallel to the traversing direction of the carriage, which in turn is approximately orthogonal to the direction of print media advance. Because of the photofabrication techniques employed in fabricating orifice plate 27, the location of orifices 29, relative to the detent edge D, is accurately the same for each print/cartridge orifice plate. Thus the plurality of print/cartridges inserted into nests 5–8 will print cooperatively without any offset artifacts due to vertical, spaced or rotational nonalignments, relative to the print zone P, between the different print/cartridges. While this physical positioning structure is highly useful, it will be understood that other print/cartridge positioning structures can be used in combination with the horizontal drop placement control sub-system of the present invention.

Thus, according to the present invention, the ink jet printer shown in FIG. 1 also includes a sub-system for the control of drop placements, horizontally (i.e. along the direction of carriage traverse), between the cooperative print/cartridges in nest 5–8. Such sub-system in general comprises control means for detecting and storing relative transverse location data for the orifice array of each print/cartridge and means for controlling the print drop actuation of each print/cartridge according to its particular location data. In the FIG. 1 embodiment such detecting means comprise a print/cartridge scan detector device 60 located at a fixed position along the path of carriage traverse and carriage postion detector device 70 comprised of a linear encoder strip 71 mounted along the traverse path of the carriage 4 and a strip decoder 72 attached to the carriage for movement in operative relation with the encoder strip 71. In general, the function of the scan detector device 60 is to signal the passage of a unique print/cartridge characteristic that is indicative of the precise transverse location (relative to the scan detector) of that print/cartridge's linear orifice array 29 as the carriage traverses the print/cartridge past the scan detector on its movement toward the print platen 2. In general, the function of the carriage position detector device 70 is to sense and signal successive instantaneous positions of the carriage 4 during its traversing movements.

Figure 10:
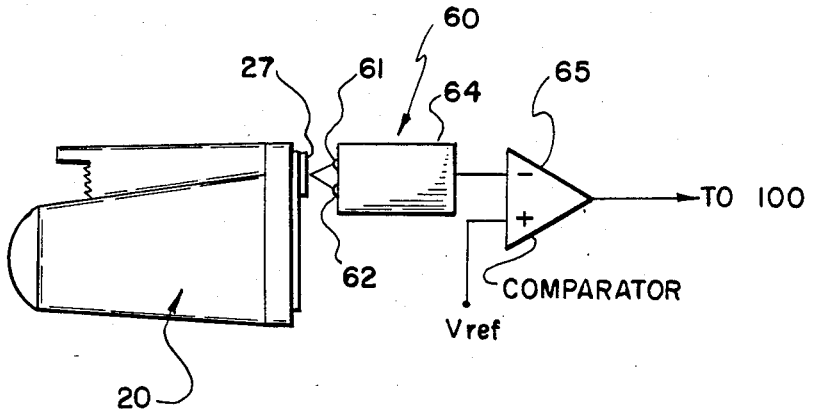
FIG. 10 is a schematic perspective view showing one means for detecting relative-transverse location of print/cartridge orifice arrays in accord with the present invention.

Referring now to FIG. 10, the scan detector device 60 comprises an infrared emitter 61, e.g. an LED, and infrared detector 62, e.g. a phototransistor, both supported in predetermined orientations and spacial relations in sensor block 64. Thus, the emitter 61 is located to direct light obliquely toward the path of a traversing print/cartridge 20 so that when an orifice plate 27 of such cartridge is in the beam of the emitter, its light is reflected by the bright nickel orifice plate metal to return to the detector 62 as shown. Other portions of the print/cartridge are formed of non-reflective material, e.g. black plastic, so that the light energy received by detector 62 during the passage of an orifice plate is significantly greater than when an orifice plate is not in the path of the emitter light beam. As illustrated schematically in FIG. 10, the output of detector 62 is coupled to comaprator 65; and when the detector voltage $V_D$ from the detector 62 increases above threshold voltage $V_{ref}$, the shift of comparator 65 to its low state is transmitted to the interface of a microcomputer 100. As will be described in more detail subsequently, the microcomputer interprets such signal from the comparator 65 as the passage event for a leading edge of orifice plate 27. When the print/cartridge orifice plate passes out of the beam from emitter 61, the output of comparator 65 returns to a high state signalling the microcomputer of this trailing edge passage event. One important purpose of carriage position detector 70 is to relate the leading edge/trailing edge events signalled by the scan detector 60 to the positions of the carriage along its traversing path.

Figure 9A:
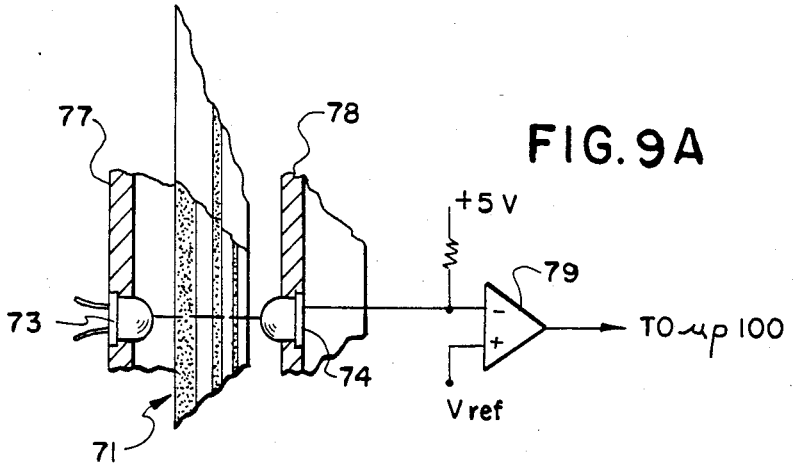
FIGS. 9A and 9B are schematic perspective views illustrating carriage position detection means in accord with one preferred embodiment of the present invention.
Figure 9B:
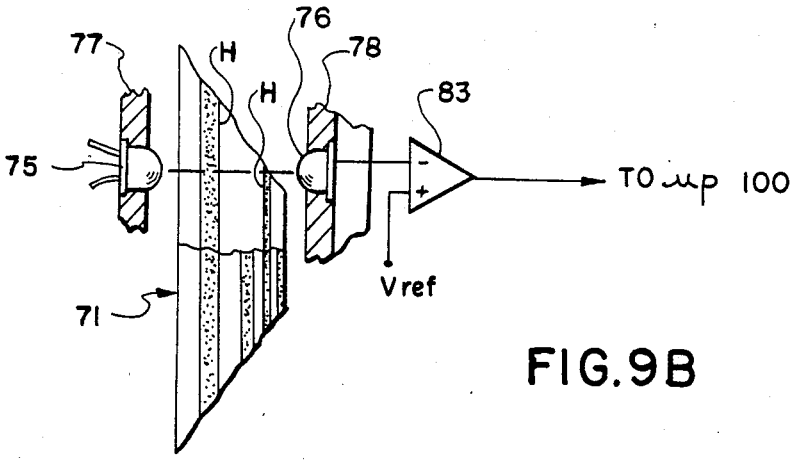

Referring now to FIGS. 9A and 9B, as well as FIG. 1, carriage position detector 70 comprises a strip decoder portion 72 which is mounted for movement with carriage 4 and which includes emitter and detector pairs 73, 74 and 75, 76. The emitters and detectors are disposed in opposing relation respectively on extensions 77, 78 of carriage 4 so as to sandwich the linear encoder strip 71 during the traversing movement of the carriage. As shown in FIG. 9A, the lower portion of the linear encoder 71 comprises a plastic strip of alternating transparent and opaque sections, e.g. each section 2.6 mils wide. Emitter-detector pair 73, 74 is arranged to pass and receive light through this lower strip portion and the power to the emitter 73 is adjusted such that the detector 74 operates in a nonlinear region. Thus, the detector 74 will output a triangular sinusoidal-like voltage waveform in response to modulation by the lower portion of strip 71. The signal from detector 74 is coupled to a comparator 79 which has a threshold voltage level $V_{ref}$ such that the output of comparator 79 changes state at the same stage of every transparent-opaque encoder transition past the detector. As shown in FIG. 9A, the pulse train produced as the output of comparator 79 is applied as separate inputs **84*a* and 84*b* to microprocessor 100 for purposes subsequently described. Emitter-detector pair 75, 76 shown in FIG. 9B is arranged to pass and receive light through the upper part of the encoder strip which has only opaque traverse location markers H. The output of detector 76 is compared by comparator 83 to $V_{ref}$ and the low output from comparator 83 signals the microcomputer 100** that the carriage has reached a certain point(s) along its printing path, e.g. a turn-around location. Further details of useful detector systems are described in the above-noted, concurrently filed application by Piatt, Theodoras and Ray, which is incorporated herein by reference.

Figure 11:
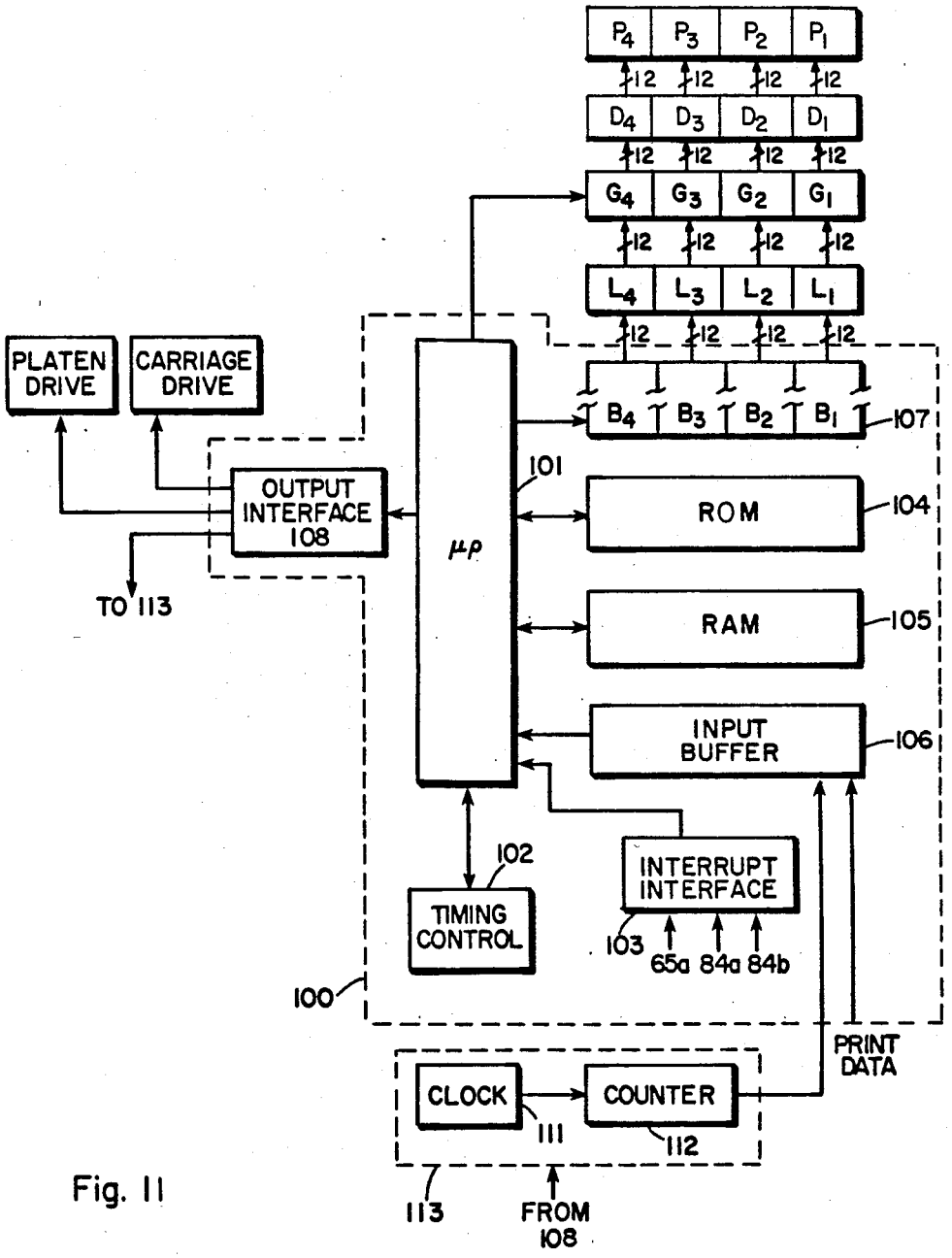
FIG. 11 is a schematic diagram illustrating one control system in accord with the present invention.

Considering the foregoing, there has been described means for detecting the print/cartridge orifice plates' passage of a predeterminedly placed detector and means for detecting various dynamic positions of the carriage 4 along its transversing path. The cooperative functioning of these detecting means as well as the overall operation of the printer in accord with the present invention can be futher understood by referring to FIGS. 11–15. As shown in FIG. 11, microcomputer control system 100 comprises a microprocessor 101 with related timing control and interrupt interface sections 102, 103 and cooperative read only memory (ROM) 104 and read/write memory (RAM) 105. The system 100 also includes input and output buffer interface sections 106, 107 adapted to receive, store and output data for the microprocessor 101. The printer also includes for cooperating with its microcomputer control system 100, an input system 113, including a clock 111 and counter 112, whose function will be described subsequently.

Figure 12:
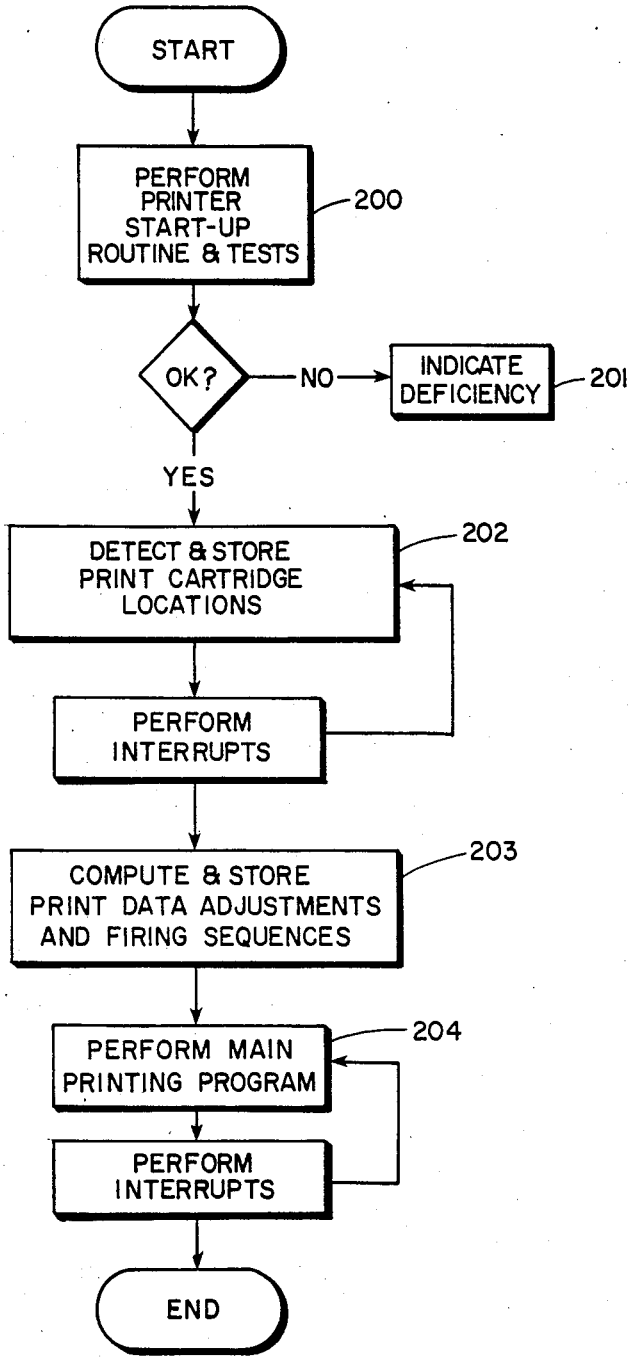
FIGS. 12–15 are flow charts useful in explaining processes performed by the FIG. 11 system.

As indicated by the general flow chart of FIG. 12, the ROM 104 contains programs whereby the microcomputer is, in general, adapted, on start-up, to perform routines such as activating paper drive and carriage drive motors, supplying energy for the print/cartridges, etc., as well as tests for the attainment of proper start-up conditions, e.g. adequate power supply, paper supply, etc. As also shown in FIG. 12, before commencing with the main printing program 204, the control system is programmed, in ROM 104, to detect and store (process 202) the locations of inserted print/cartridges and (process 203) to compute and store (i) data for adjusting the flow of print data from the output buffer 106 and (ii) data for controlling the firing sequences of inserted print/cartridges during the normal printing operations (process 204).

Figure 13:
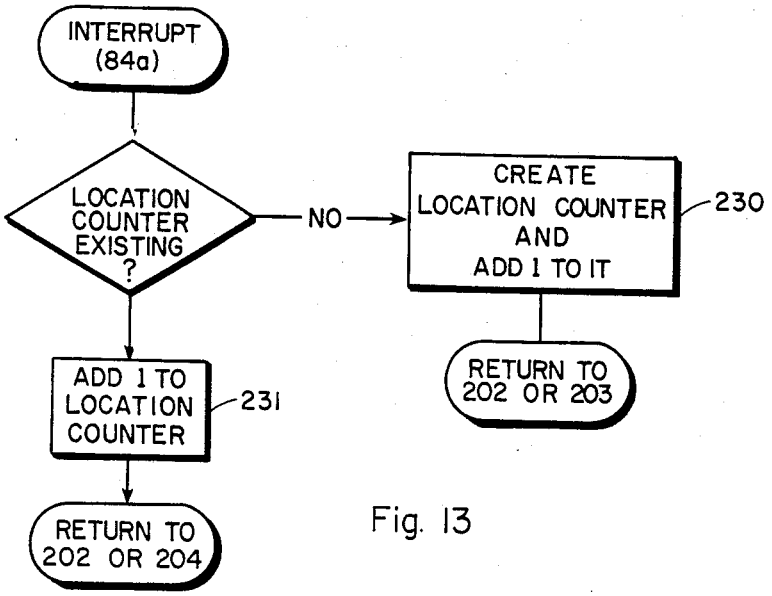

More specifically, after print/cartridges $P_1$–$P_4$ have been inserted as described above and the start-up test routines (process 200) have been performed, the printer proceeds, under the control of a program in ROM 104, with detect and store function (process 202) as follows. The cartridge drive 90 is activated to move a predetermined home station location to the left of the sensor 60 and to then traverse it from left to right past the sensor at a nominal scan speed which is slower than the transversing speed during printing. When the carriage position detector 74 initiates the first pulse from comparator 79 to interupt port 84*a* of the interrupt interface 103, the procedure shown in FIG. 13 is transferred from Rom 104 to ROM 105. Thus, the interrupt signal will then effect creation of a carriage position counter (process 230) in RAM 105, input a count of "1" to the counter and return the microprocessor to other control functions. WHen the next pulse from comparator 79 is input at port 84*a*, the carriage position count will be added to by 1 (process 231) and the microprocessor again returned to other work. The sub-routine described with respect to FIG. 13 operates both in the detect and store function (process 202) and the main printing function (process 204).

Figure 14:
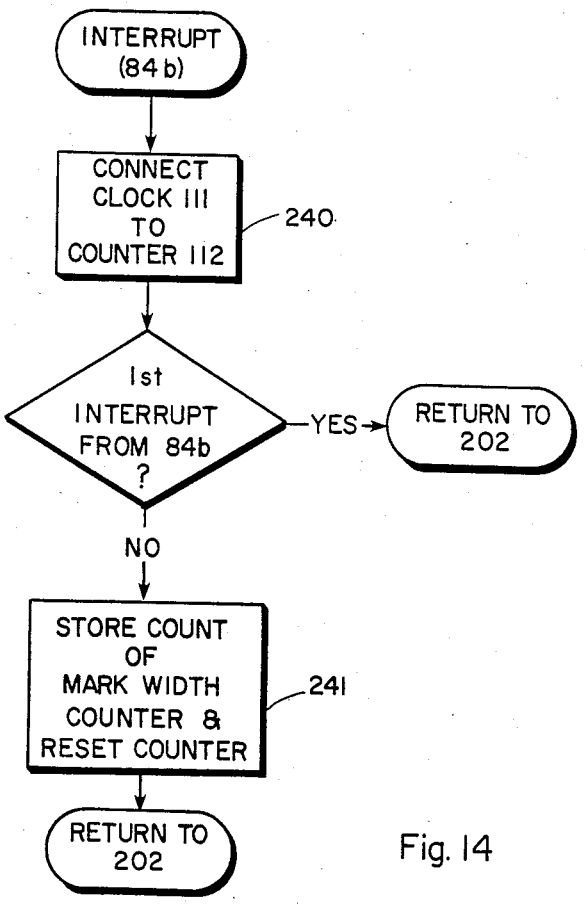

Referring now to FIG. 14, as well as FIG. 11, it can be seen that the pulse train from comparator 79 is also applied to input port 84*b* of interrupt interface 103. This interrupt signal connects clock 111 to counter 112 to begin producing an intra-mark count for the first encoder marking on encoder strip 71. That is, the clock 111 is selected with a frequency that divides each mark (opaque and transparent) of strip 71 into a nominal intra-mark resolution, when the carriage is moving at the nominal scan-detect speed. It should be noted that if the nominal clock speed were selected to yield 300 counts between mark transitions at the nominal carriage scan-detect speed, variations in that speed might yield an intra-mark count of 280 (if above nominal speed) or 320 (if below nominal speed). As shown in FIG. 14, after receipt of the first interrupt signal at port 84*b*, the counter is started and control of the microprocessor is relinquished. However, upon receipt of each subsequent 84*b* interrupt, a mark width count is stored and the counter is reset to "0". Thus, during the transverse of the carriage, the microcomputer has an access to (i) the dynamic intra-mark count of the mark then passing detector 74 and (ii) the entire intra-mark count of the most recently passed mark. Both these data are useful in converting the intra-mark count to intra-mark phase information in the computation process 203 to be described later.

Figure 15:
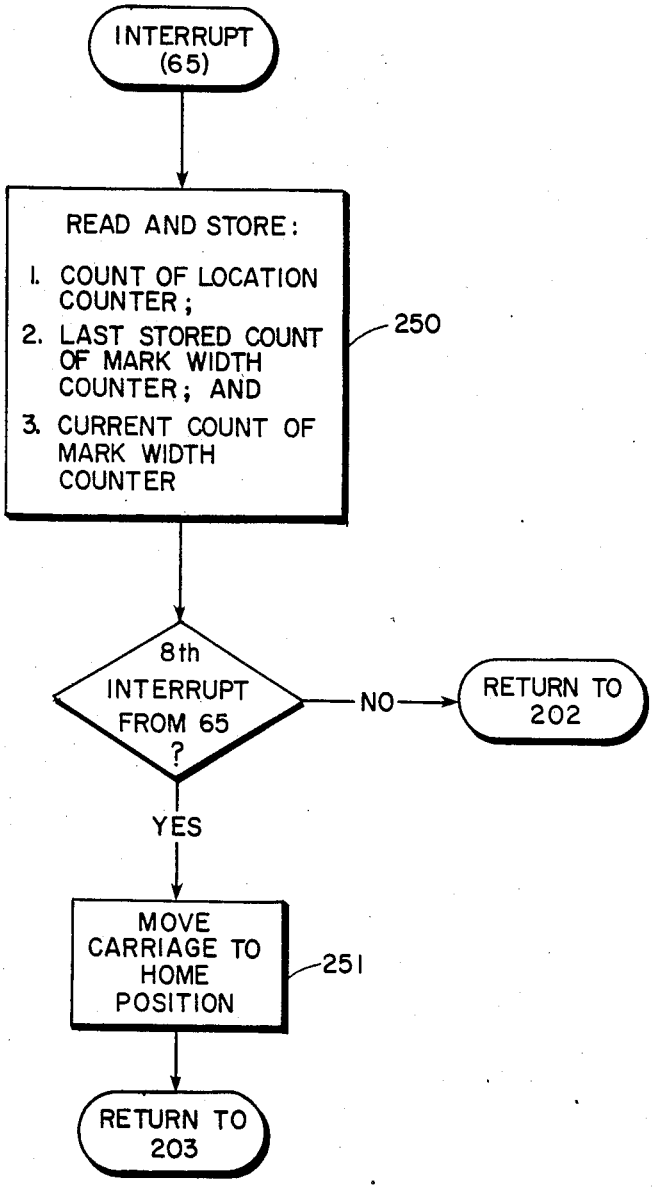

Referring next to FIG. 15, as well as FIG. 11, it can be seen that when a signal from comparator 65 of orifice plate detector 60 is supplied to interrupt port 65*a* of the microcomputer, a subroutine is addressed in ROM 104 which directs the microprocessor in: (i) reading and storing the mark count then stored in the carriage position counter, created and updated by the FIG. 13 subroutine, (ii) reading and storing intra-mark count of the then most recently passed mark, stored by the FIG. 14 subroutine, and (iii) reading the then existing clock count of intra-mark counter 112 (process 250).

The abvove-described procedures continue as the print/cartridge moves the leading and trailing edges of each of the print/cartridges orifice plates past sensor 60. After the 8th interrupt procedure of reading and storing, an orifice plate edge data (assuming a four print-/cartridge printer), the carriage 4 is returned to the home position (process 251) and computations in accord with process 203 commence. In general, the process 203 is performed by microprocessor 101 under control of a program in ROM 104, using orifice location data stored in RAM 105 as described above, and has two main objectives, viz. (i) to determine and store the precise transverse distances between the orifice arrays of print-/cartridges $P_1$–$P_4$ and (ii) to determine and store the optimum firing sequences for those print/cartridges, as then located. Both of these determinations are useful in coordinating printing with inserted print/cartridges to avoid drop placement artifacts in the transverse page direction.

The distances between the linear orifice arrays can be determined by a number of simple algorithms, based on the fact that the orifice arrays are all precisely located relative to the leading and trailing edges of their orifice plate. Several such procedures are described in concurrently filed U.S. application Ser. No. 945,137, entitled "System for Determining Orifice Interspacings of Cooperative Ink Jet Print/Cartridges" by Piatt, Theodoras and Ray. By virtue of the intra-mark detection features of the present invention, additional resolution information is available to even more precisely interrelate the cooperative orifice arrays in printing. One useful algorithm for attaining advantage of the intra-mnark data is as follows:

1. Determine each orifice plate edge location as a mark plus phase (fractional mark count) datum by:
   (a) Dividing its current intra-mark count from counter 112 (stored by procedure 250) by the last previous full mark width count (stored by procedure 250); and
   (b) Adding the resultant fraction to the location counter count (stored by procedure 250).

2. Determine the mark count plus phase location datum of the orifice array of each print/cartridge by: (i) comparing count plus phase of datum of its edges, (ii) multiplying the remainder of such comparing by a parameter representing the location of the array between the edges and (iii) adding this intra-mark fraction to leading edge location as computed by (1) above. In the following example of this process it is assumed that the array of orifices trails the leading edge of the orifice plate by 0.75 of the orifice plate transverse dimension and calculations are illustrated to identify the orifice array location precisely. However, as will become clear substantially, in many instances only the precise inter-orifice-plate distances are utilized so that location of a center of orifice plate symmetry (in the transverse dimension) can be utilized to determine the operative transverse spacing between corresponding portions of adjacent orifice plates rather than dealing with the actual orifice array locations.

EXAMPLE

If the location data of the first print/cartridge edges are:

Leading edge: 902 marks, 230 intra-mark counts, and last previous mark count 311

Trailing edge: 1340, 110 and last previous mark count 291, the leading edge location equals $902+(230\div311)=902.74$ and the trailing edge location equals $1340+(110\div291)=1340.38$ If the orifice array is located 0.75 of the orifice plate width from the leading edge, the orifice array location equals $902.74+0.75(1340.38-902.74)=1230.97$.

3. Determine the mark plus phase spacings (S) between each of the print cartridge orifice arrays and the first print/cartridge array, e.g.:

$P_4=6127.88$ $P_3=4436.09$ $P_2=2865.74$ $P_1=1230.97$
$S_{1-3}=4896.91$ $S_{1-3}=3205.12$ $S_{1-2}=1634.77$

These spacing data are computed and stored (process 203) and provide information useful for determining print data loading and print head firing sequence adjustments, as will become clear in view of the subsequent explanation of the modes of loading print data into output buffer 107 of the microcomputer.

Figure 16:
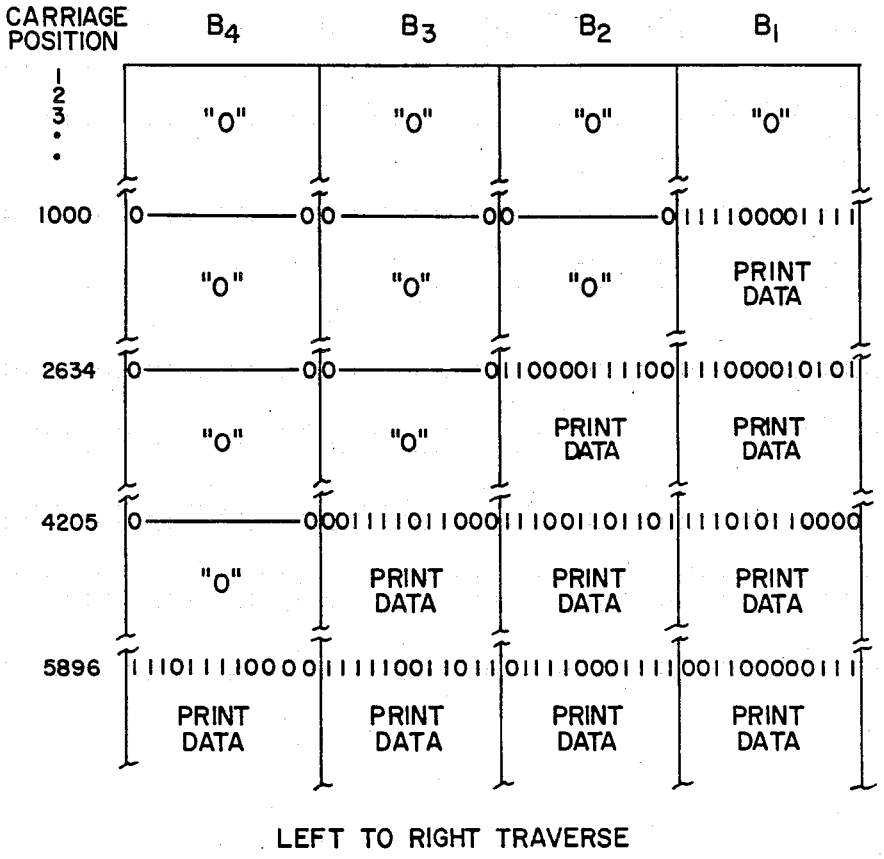
FIGS. 16 and 17 are diagrams useful in explaining the operation of the present invention.

Referring now to FIGS. 11 and 16, one embodiment for effecting transverse drop placement coordination in accord with the present invention will be described. Thus, it can be seen that a buffer output memory 108 contains separate channels $B_1$–$B_4$ respectively for receiving print data for each of the print/cartridges $P_1$–$P_4$. In operation, the print data is received by the input buffer of microcomputer 100 and loaded into the buffers $B_1$–$B_4$ by the microprocessor in particular sequences determined by a program in ROM 104 utilizing the orifice array location data described above, which is stored in RAM 105. More particularly, referring to FIG. 16 (in which "1" indicates a digital signal to eject an ink drop and "0" indicates a non-eject signal), it can be seen that data is loaded into buffer channel $B_1$ so that the first print signals will be ready for output from the buffer at position 1000 of the print head carriage 4. That is, this example assumes that the first possible line print position is 1001 encoder marks to the right of the home station (or start-count mark) and that the buffer is actuated to advance data in its channels one position per encoder mark. Referring again to FIG. 11, it will be seen that upon the 1001 transition pulse, latch $L_1$ is loaded with print/no-print data from buffer $B_1$ while latches $L_2$–$L_4$ are loaded with all 0's from their respective buffer channels. Thus, when the gates $G_1$–$G_4$ are enabled at this print position 1001, the twelve (12) drivers for the 12 orifices of print/cartridge $P_1$ will be fired according to the "0" or "1" information in the latches $L_1$ and appropriate ink drops will be ejected to the print line by $P_1$. As shown in FIG. 16, this condition will continue until position 2634 (i.e. 1000+count spacing $S_{1-2}$ of 1634) evolves, at which time print/no-print data for print/cartridge $P_2$ will be ready for output to its latches $L_2$.

Reflecting on what has been described, it will be understood that the loading of the buffers $B_1$–$B_4$ will accomplish a delay between the commencement of printing which has been computed and stored (as described previously—process 250) to attain accurately coordinated transverse drop placement between the print/cartridges as physically positioned. Thus, print/cartridge $P_2$ will be provided with printing information 1634 mark transitions after $P_1$, $P_3$ will be provided with printing information 3205 mark transitions after $P_1$, and $P_4$ will be provided with printing information 4896 mark transitions after $P_1$. Each of the buffers will continue to output printing data to its latches until its full line of print data is completed and will thereafter output all "0's". Therefore, as would be expected, print/cartridge $P_1$ will cease printing first, $P_2$ second, $P_3$ third and $P_4$ will cease printing last.

If desired, the twelve drivers for each print/cartridge can be fired sequentially (e.g. 1 to 12 or in pair sequence 1 and 6, 2 and 7, etc.) This is accomplished by the gate control signals supplied by microprocessor under the control of a sequence program in ROM 104. This can be advantageous from the viewpoints of reducing thermal and acoustic crosstalk and of reducing peak power requirements for the drivers' energy source. In addition, the program of ROM 104 desirably provides for the microprocessor's sequential enablement of each gate groups $G_1$–$G_4$, and in this preferred mode of operation, the phase (fractional mark) spacing data that was calculated and stored (process 250) is useful. Thus, consider the spacing data calculated according to the previous example where $S_{1-4}=4896.91$; $S_{1-3}=3205.12$ and $S_{1-2}=1634.77$. In accordance with print head firing sequence algorithm, the gate group for the first print/cartridge ($P_1$ when moving left to right) will be enabled first at each encoder transition. Thereafter, the print/cartridge firing order proceeds from the smallest to greatest fractional mark spacing from $P_1$. Thus, in the example above, gate group $G_3$ for print/cartridge $P_3$ (phase spacing 0.12) should be enabled next after gate group $G_1$; gate group $G_2$ for print/cartridge $P_2$ (phase spacing 0.77) next after group $G_3$ and finally gate group $G_4$ for print/cartridge $P_4$ (phase spacing 0.91) would be enabled.

More specifically, it is preferred in accord with the present invention that the gates $G_3$, $G_2$ and then $G_4$ be enabled at particular intra-mark counts after the enablement of gate $G_1$ that reflects the particular phase spacing of its related print/cartridge from print/cartridge $P_1$. This preferred procedure will accomplish precise drop placements of the ink drops from each of print/cartridges $P_2$–$P_4$ on the same pixel locations that are defined by the ink drop placements of print/cartridge $P_1$ as it is enabled and fired at each encoder transition signal. For example, considering exemplary the phase spacing information derived above, in a left-to-right printing traverse of carriage 4, the gates $G_3$ would be enabled 0.12 of the nominal 300 intra-mark counts of an encoder signal transition or 36 intra-mark counts after gates $G_1$. Similarly gates $G_2$ will be enabled 231 intra-mark counts after $G_1$ (i.e. $0.77\times300$) and $G_4$ 273 intra-mark counts after $G_1$ (i.e. $0.91\times300$). It will be noted that the above-described embodiment utilizes the nominal intra-mark count of 300 without any adjustment based on the intra-mark count of a next-previous encoder mark. It has been found that at the higher printing-transverse speed of the carriage 4, the mechanical system inertia is such that reliable printing drop placement can be achieved by the servo controls of the carriage drive in combination with the just-described gate enablement technique. Thus referring to FIG. 11, gates $G_1$ will be enabled by microprocessor 101 on the signal from comparator 79, and successively thereafter at respective counter counts of 36, 231 and 273 gates $G_3$, $G_2$ and $G_4$ will be enabled by microprocessor 101. It should be made clear that, in addition to the sequential enablement of gate groups, the enablement of the 12 gates within each gate group can also be implemented sequentially or in pairs by a program within the microcomputer, so that at any one instant only 1 or 2 of the 48 drivers are energized.

Figure 17:
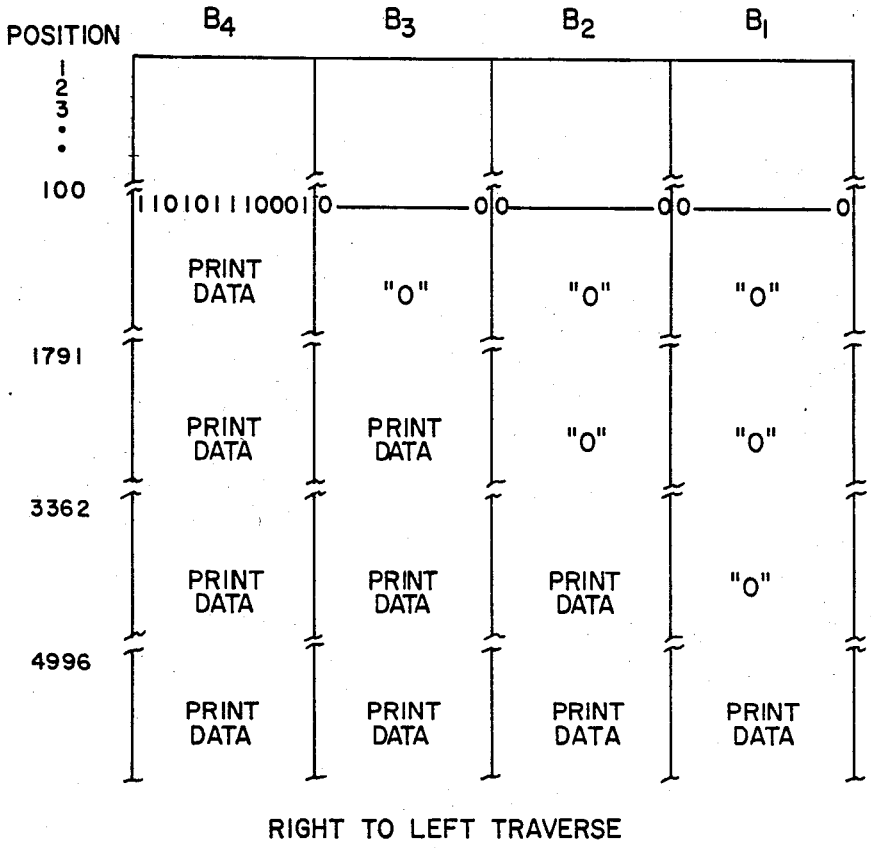

As alluded to previously, the approach of the present invention as described above with respect to a left to right printing transverse can be extended to a return (i.e. right to left) printing transverse. Thus, referring to FIG. 17, it will be seen that print data is loaded into the buffers $B_1$–$B_4$ so that print data for print/cartridge $P_4$ will be ready for output at 101 encoder transitions (in the right to left direction from the right-most carriage stop, e.g. mark H shown in FIG. 9B). Similarly, buffer $B_3$ will be ready to output print data after 1791 mark transitions (right to left), buffer $B_2$ after 3362 such transitions and buffer $B_1$ after 4996 such transitions. In the reverse printing mode the firing sequence algorithm is different from the left to right printing mode, viz: gate group $G_1$ enabled at the mark transition, and other gates enabled in sequential order of smallest to largest complementary phase spacing from $P_1$. That is, the phase spacing for gate enablement is now the phase complement of the above-described left to-right phase spacing. Thus in the given example the gate group enablement sequence would be $G_1$, $G_4$ (complementary phase spacing $1.00-0.91=0.09$)), $G_2$ (complementary phase spacing 0.23) and $G_3$ (*complementary phase spacing* 0.88). Hence, $G_1$ would be enabled on the encoder mark, $G_4$ enabled 27 intra-mark counts after $G_1$, $G_2$ enabled 69 intra-mark counts after $G_1$ and $G_3$ enabled 264 intra-mark counts after $G_1$. In the right to left printing sequences microprocessor 101, under the control of ROM 104, provides a constant phase delay in the signals to all of gates $G_1$–$G_4$ which is calculated, based on the carriage velocity, to compensate for different transverse velocity component of the ink droplets and encoder mark width parameter interjected by opposite mark edge detection.

In accordance with another aspect of the present invention, the feature of sequential print/cartridge firing is utilized to reduce the number of drivers required from 48 to 12. Thus referring to FIG. 18, it can be seen that the control system is generally the same as described with respect to FIG. 11, except the four gate groups $G_1$–$G_4$ have their outputs coupled to a common driver group that is adapted to address the four print/cartridges $P_1$–$P_4$ in multiplexed fashion. More particularly, each of the gate groups contains 12 outputs respectively coupled to one of the twelve drivers 180. The gate groups are selectively enabled by the microprocessor as previously described (the individual gates of a group can also be enabled sequentially or in pairs as before stated). Each of the twelve drivers is coupled to a corresponding heater element in each of the four print/cartridges $P_1$–$P_4$ and the common ground electrodes of the heater elements of each print/cartridge are selectively connectable to ground potential 181 by field effect transistor elements $f_1$–$f_4$ which can be opened and closed by shift register S/R in response to control inputs from the microprocessor.

In operation at each printing position the gates $G_1$–$G_4$ are sequentially enabled by the microprocessor in accordance with firing sequence computed and stored in RAM and concurrently, the microprocessor enables the firing circuit for the drivers to the corresponding print head. For example, if the computed firing sequence was $P_1$, $P_3$, $P_2$, $P_4$, gate $G_1$ would be first enabled and at the same time microprocessor, operating through shift register S/R, would close transistor $f_1$ through its related amplifier. At this stage, the fire/no-fire signals from latch $L_1$ would appropriately activate the twelve drivers to emit electrical energy pulses sufficient to thermally eject ink drops. These pulses would find a closed circuit to ground only through the heater elements of the print/cartridge $P_1$. Upon completion of the $G_1$ enablement(s) for that print position, the same procedure would occur for gate group $G_3$ and related switch $f_3$ that directs the drive pulses through the heater elements of print/cartridge $P_3$. After the sequence was repeated for print/cartridges $P_2$ and $P_4$, the data buffers $B_1$–$B_4$ would load latches $L_1$–$L_4$ with data for the next print position and the multiplexed firing cycle would be repeated.

Figure 18:
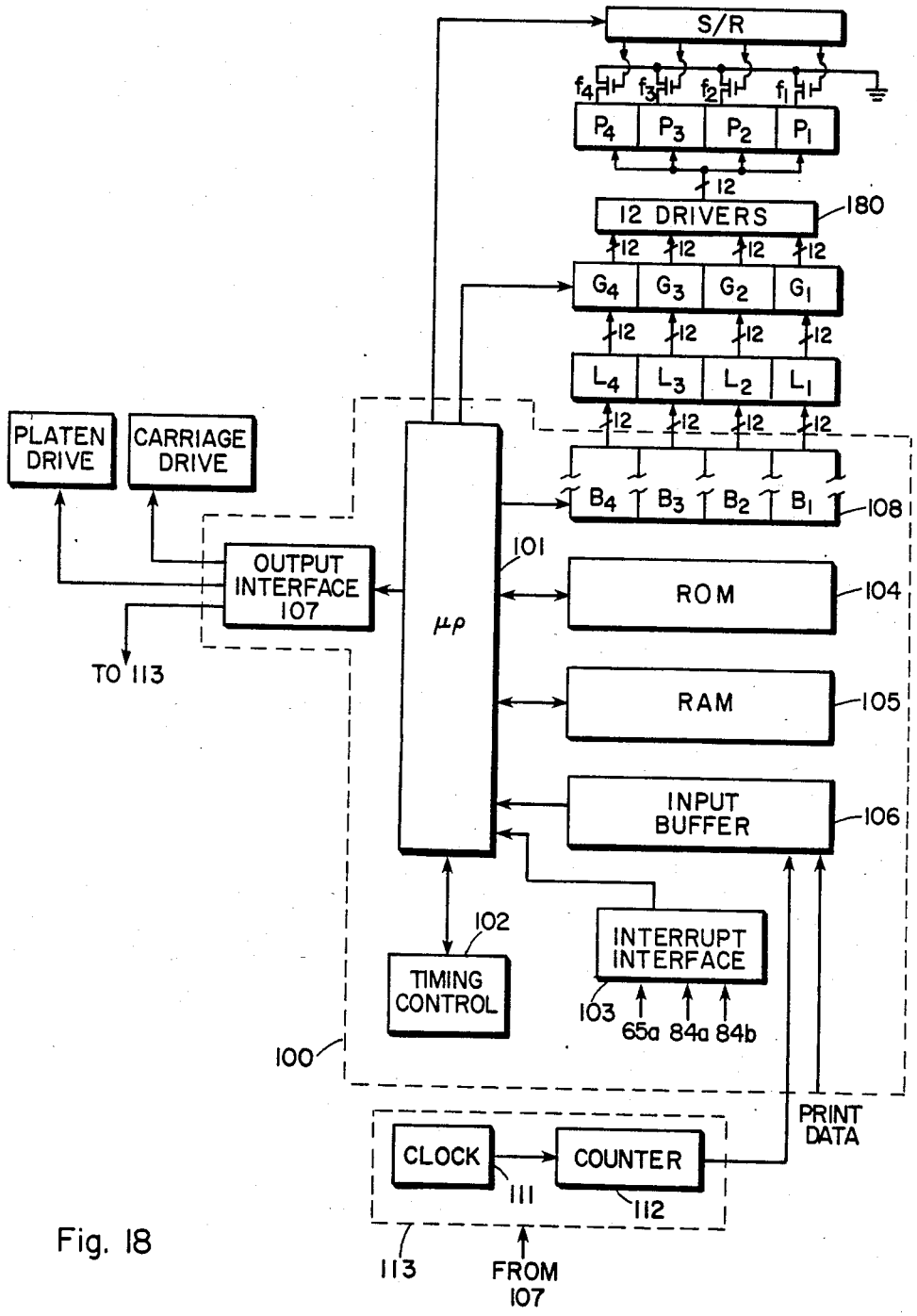
FIG. 18 is a schematic diagram similar to FIG. 11, but illustrating another embodiment of the present invention.

In an alternative preferred embodiment for multiplexing the firing of the print/cartridges $P_1$–$P_4$, the shift register S/R described with respect to FIG. 18 can be addressed to control FET's $f_1$–$f_4$ to selectively couple the common electrode of the print/cartridges to an energizing voltage, rather than ground. In this embodiment the outputs of latches $L_1$–$L_4$ would load gates $G_1$–$G_4$ to effect a grounding of the separate resistor leads in accordance with the print information in the latches.

It will therefore be appreciated that the multiplexing capable of the present invention such as described above cooperate in a unique and highly advantageous manner with the sequential print/cartridge firing features of the present invention.

The invention has been described in detail with particular reference to preferred embodiments thereof, but it will be understood that variations and modifications can be effected within the spirit and scope of the invention. For example, it will be appreciated that the features of the present invention can also be utilized with advantage in systems adapted to use insertable print heads which are couplable to ink reservoirs that are not integral with the print head.

I claim:

1. In ink jet printing apparatus adapted for printing successive pixels along a linear print zone with a plurality of print/cartridges, including orifice arrays, a drop placement coordination system comprising:

(a) carriage means, constructed to traverse said print zone, for insertably receiving a plurality of such print/cartridges with their orifice arrays spaced in the direction of carriage traverse;

(b) means for determining and storing data representing the transverse inter-spacings of such orifice arrays in the form of pixel-count and intra-pixel phase information; and (c) means for controlling the actuations of each received print/cartridge in accordance with said stored data, said controlling means including gate means for sequencing the provision of printing information signals to each print/cartridge on the basis of particular pixel-count, inter-spacing data.

2. In ink jet printing apparatus adapted for printing successive pixels along a linear print zone with a plurality of insertable printing devices, each including an orifice array, a drop placement coordination system comprising:

(a) traversing means for insertably receiving such printing devices with their orifice arrays respectively disposed in transversely spaced relations;

(b) means for determining and storing the relative transverse locations of such orifice arrays in the form of pixel count and intra-pixel count data; and (c) means for controlling the printing from each array respectively in accordance with its pixel count and intra-pixel count data.

3. In ink jet printing apparatus adapted for printing successive pixels along a linear print zone with a plurality of print/cartridges, including orifice arrays, a drop placement coordination system comprising:

(a) carriage means, constructed to traverse said print zone, for insertably receiving a plurality of such print/cartridges with their orifice arrays spaced in the direction of carriage traverse;

(b) means for determining and storing data representing the transverse inter-spacings of such orifice arrays in the form of pixel-count and intra-pixel phase information; and (c) means for controlling the actuations of each received print/cartridge in accordance with said stored data, said controlling means including means for enabling the actuation of each print/cartridge in a sequential order based on stored intra-pixel phase information.

4. In ink jet printing apparatus adapted for printing successive pixels along a linear print zone with a plurality of print/cartridges, including orifice arrays, a drop placement coordination system comprising:

(a) carriage means, constructed to traverse said print zone, for insertably receiving a plurality of such print/cartridges with their orifice arrays spaced in the direction of carriage traverse;

(b) means for determining and storing data representing the transverse inter-spacings of such orifice arrays in the form of pixel-count and intra-pixel phase information; and (c) control means for controlling the actuations of each received cartridge in accordance with said stored data, said control means including:

(1) gate means for sequencing printing information signals to received print/cartridges on the basis of their stored pixel-count, inter-spacing data; and (2) means for enabling the actuation of each print/cartridge in a sequential order based on stored intra-pixel phase information.

5. The invention defined in claim 4 wherein said enabling means includes means for multiplexing the coupling of an electrical power circuit sequentially in said sequential order.

6. In ink jet printing apparatus adapted for printing along a linear print zone with a plurality of insertable print/cartridges, including orifice arrays, an interface system coordinating the drop placements of such print/cartridges comprising:

(a) carriage means constructed for traversing said print zone and for releasably supporting a plurality of such print/cartridges with their orifice arrays in a vertically indexed, transversely spaced relation;

(b) means for determining and storing the transverse inter-spacing of such orifice arrays in the form of carriage-traverse count and count phase data; and (c) means for controlling the printing by each supported print/cartridge in accordance with said stored data, said controlling means being constructed to:

(1) sequence the provision of printing information to such print/cartridge on the basis of stored count data; and (2) enable print/cartridge actuations sequentially on the basis of stored count phase data.

7. In ink jet printing apparatus adapted for printing along a linear print zone with a plurality of print/cartridges, each including orifice means, and an interface system for coordinating the drop placements from such print/cartridges, which includes:

(a) traversing carriage means for releasably supporting a plurality of such print/cartridges in transversely spaced relation with their orifice means vertically indexed to a carriage reference means;

(b) means for detecting and storing the relative transverse locations of such orifice means; and (c) means for controlling the printing by each supported print/cartridge according to its transverse location, the improvement wherein:

(i) said detecting and storing means is constructed to detect and store orifice means inter-spacings in the form of an encoder mark-count plus intra-mark phase information; and (ii) said controlling means is constructed to:

(1) sequence printing information signals for such print/cartridges on the basis of stored mark-count inter-spacing data; and (2) enable print/cartridge actuations in a sequential order based on stored intra-mark phase information.

8. In ink jet printing apparatus adapted for printing successive pixels along a linear print zone with a plurality of insertable orifice means, a drop placement coordination system comprising:

(a) traversing means for insertably receiving a plurality of such orifice means in a transversely spaced relation;

(b) means for determining and storing the relative transverse locations of such orifice means, said determining means including means for detecting and storing orifice means locations in the form of pixel-count plus intra-pixel phase information and means for computing data representing the orifice means spacings, from a lead orifice means, as pixel-count plus intra-pixel phase data; and (c) means for controlling the drop ejections from each received orifice means in accordance with its stored transverse location data.

* * * * *